US007591160B2

(12) United States Patent
Keller

(10) Patent No.: US 7,591,160 B2
(45) Date of Patent: Sep. 22, 2009

(54) ELECTROMECHANICAL LOCK CYLINDER

(75) Inventor: Ernst Keller, Richterswill (CH)

(73) Assignee: Keso AG, Richterswil (CH)

( * ) Notice: Subject to any disclaimer, the term of this patent is extended or adjusted under 35 U.S.C. 154(b) by 220 days.

(21) Appl. No.: 10/592,227

(22) PCT Filed: Mar. 8, 2005

(86) PCT No.: PCT/CH2005/000140

§ 371 (c)(1),
(2), (4) Date: Sep. 11, 2006

(87) PCT Pub. No.: WO2005/088040

PCT Pub. Date: Sep. 22, 2005

(65) Prior Publication Data

US 2008/0028808 A1 Feb. 7, 2008

(30) Foreign Application Priority Data

Mar. 11, 2004 (EP) ..... 04405142

(51) Int. Cl.
*E05B 47/06* (2006.01)

(52) U.S. Cl. ..... 70/277; 70/278.3; 70/278.7; 70/279.1; 70/374

(58) Field of Classification Search ..... 70/277, 70/278.2, 278.3, 278.7, 279.1, 283.1, 374, 70/278.1, DIG. 60, DIG. 63
See application file for complete search history.

(56) References Cited

U.S. PATENT DOCUMENTS 2,381,136 A * 8/1945 Oxhandler ..... 70/374
5,010,752 A * 4/1991 Lin ..... 70/277
5,027,629 A * 7/1991 Liu ..... 70/277
5,373,718 A * 12/1994 Schwerdt et al. ..... 70/278.3
5,447,047 A * 9/1995 Lin ..... 70/218
5,685,182 A * 11/1997 Chhatwal ..... 70/224
5,839,305 A * 11/1998 Aston ..... 70/283.1
5,960,656 A * 10/1999 Yao ..... 70/472
6,227,020 B1 * 5/2001 Lerchner ..... 70/278.3
6,334,347 B1 * 1/2002 Iscla ..... 70/278.3
6,418,764 B1 * 7/2002 Lerchner ..... 70/279.1
6,523,377 B1 * 2/2003 Vonlanthen ..... 70/278.3
6,865,916 B2 * 3/2005 Goldman ..... 70/472
7,231,791 B2 * 6/2007 Sakai ..... 70/277

(Continued)

FOREIGN PATENT DOCUMENTS

DE 199 30 054 C2 6/1999

(Continued)

*Primary Examiner*—Lloyd A Gall
(74) *Attorney, Agent, or Firm*—Browdy and Neimark, P.L.L.C.

(57) ABSTRACT

The invention relates to an electromechanical lock cylinder, comprising a first cylinder half (2), arranged on the outside of the door, with a key passage (8) for a security key (44) and a second cylinder half (3), arranged on the inside of the door, with a rotating knob rotor (4). Tumblers in the first cylinder half (2) are arranged for rotational release by a security key (44). An electronic device (17) is arranged in the rotating knob (24) for control of a locking device (43). The rotating knob (24) forms a unit with the electronic device (17) arranged therein, detachably mounted on an extension (4*a*) of the rotating knob rotor (4), projecting past the housing (6). The rotating knob rotor (24) may be adjusted for length by means of an exchangeable adapter (18*a* to 18*c*).

14 Claims, 5 Drawing Sheets

U.S. PATENT DOCUMENTS

| | | | | |
|---|---|---|---|---|
| 2001/0023602 | A1* | 9/2001 | Doerr et al. | 70/278.3 |
| 2003/0217574 | A1* | 11/2003 | Meis | 70/257 |
| 2004/0040355 | A1 | 3/2004 | Goldman | |
| 2006/0156771 | A1* | 7/2006 | Hauri | 70/278.7 |
| 2008/0078220 | A1* | 4/2008 | Kim | 70/283.1 |

FOREIGN PATENT DOCUMENTS

| | | | |
|---|---|---|---|
| DE | 102 26 882 | A | 3/2003 |
| EP | 0 428 892 | A | 5/1991 |
| EP | 0 462 316 | A | 12/1991 |
| EP | 0 588 209 | A1 | 9/1993 |
| EP | 0 743 411 | B2 | 4/1996 |
| EP | 0 816 600 | A2 | 1/1998 |
| EP | 1 079 051 | | 6/2000 |
| EP | 1 256 671 | A2 | 5/2002 |
| FR | 2 761 396 | A | 10/1998 |

* cited by examiner

ELECTROMECHANICAL LOCK CYLINDER

BACKGROUND OF THE INVENTION

1. Field of the Invention

The invention relates to an electromechanical lock cylinder, having a first cylinder half to be arranged on the outside of the door, having a key channel for a safety key and a second cylinder half to be arranged on the inside of the door, having a rotary knob rotor, which is connected to a rotary knob, having tumblers, which are arranged in the first cylinder half and which are to be positioned by the safety key in order to enable rotation, and having an electronic controller arranged in the rotary knob for the purpose of driving a blocking apparatus. The invention also relates to a rotary knob for a lock cylinder and a construction kit for producing an electromechanical lock cylinder.

2. Prior Art

Electromechanical cylinder locks have been disclosed, for example, by EP 0 816 600, DE 199 30 054 C, EP 1 256 671 A and EP 0 743 411 B. Such electromechanical cylinder locks provide a higher degree of locking security owing to electronic coding and allow for a simpler design for lock systems.

An electromechanical lock cylinder having a rotary knob on the inside of the door has been disclosed by EP 1 188 887 A. In addition to the conventional pin tumblers in the cylinder half on the outside of the door, this electromechanical lock cylinder has an electronic blocking system having an additional blocking apparatus, which is likewise arranged in the cylinder half on the outside of the door. A transmitter is arranged in the key head of the key and transmits a coded signal to a reception antenna, which is arranged in the housing of the lock cylinder. An electronic circuit analyzes the coded signal and compares it with a plurality of stored codes. If the key is identified as being authorized, a signal for unblocking the mentioned additional blocking apparatus is triggered by the electronic circuit. Unblocking takes place, for example, by a blocking pin being displaced by a motor, which is fed by a battery. This battery is accommodated, for example, in the mentioned rotary knob. After this unblocking, the lock cylinder remains blocked by the conventional tumblers, however, and can only be actuated by the key on the outside of the door once these conventional tumblers have been positioned by the mechanical coding of the key. The electronic circuit is arranged in the rotary knob and partially in the cylinder housing and forms a stationary bearing journal for the sleeve-shaped handle part of the rotary knob. The electronic circuit is fixed to the housing of the inner cylinder half by means not shown here.

EP 1 079 051 A has disclosed a locking device having a rotary knob, which has control electronics beneath a pot-shaped handle. In order to hold the control electronics, the housing of the locking device has a flange. A shaft connected to the rotor is guided through this flange. This shaft is welded to a base region of the pot-shaped handle. The pot-shaped handle is withdrawn, together with the mentioned shaft, from the housing, for example for the purpose of replacing a battery.

There is a plurality of profile variants for the lock cylinder which are available on the world market. The invention is based on the object of providing an electromechanical lock cylinder which allows for particularly economic production and fitting for all known profile variants.

In the case of an electromechanical lock cylinder of the generic type, the object is achieved by the rotary knob with the electronics arranged therein forming a unit which is mounted detachably and removably on an extension, which protrudes on the housing, of the rotary knob rotor and by the rotary knob rotor being capable of being altered in terms of its length by means of a removable intermediate piece.

OBJECT AND SUMMARY OF THE INVENTION

In the case of the electromechanical lock cylinder in accordance with the present invention, the rotary knob with the electronics arranged therein forms a unit. The connection between the electronics and the housing of the cylinder is pluggable. For this connection only one hole is required in the housing of the cylinder, and a complex screw connection is superfluous. This allows for a simple construction for a very wide variety of cylinder profiles without the previously required use of a special adapter which needed to be matched individually to each cylinder profile and screwed. The rotary knob rotor is therefore a universal carrier for various cylinder profiles, in this case it also being possible to use a rotary knob rotor without any electronics.

In accordance with one development of the invention, the rotary knob rotor can be altered in terms of its length by a removable intermediate piece. This further feature makes it possible to provide a construction kit system with which it is possible to produce cylinder locks of different lengths from the same individual parts. As a result, it is possible to achieve considerable rationalization and a considerable reduction in terms of storage.

In accordance with one development of the invention, the electronics which are accommodated in the rotary knob are connected to the housing of the second cylinder half to be arranged on the inside of the door by means of a plug-in connection. In order to produce this connection, only one hole is required in the mentioned housing. This has the significant advantage that it is possible to construct the rotary knob on a very wide variety of cylinder profiles without any problems and without any special adapters. The lock cylinder according to the invention can therefore be produced with a very wide variety of commercially available profiles.

In accordance with one development of the invention, the plug-in connection has a pin which engages, in a floating manner, in a cutout in the housing of the second cylinder half. This floating mounting has the significant advantage that the electronics in the rotary knob are protected against impacts on the cylinder. Vibrations of the cylinder are therefore not transmitted directly to the electronics.

In accordance with one development of the invention, the electronics are connected to an actuator by means of a cable, said actuator being arranged in the first cylinder half. This ensures a reliable electrical connection between the electronics and the actuator.

In accordance with one development of the invention, the cable has a plug at each of its two ends. The cable is connected with one plug to the electronics and with the other plug to the actuator or the blocking apparatus. As a result, the cable can be separated from the electronics or the actuator in a simple manner for the purpose of extending or shortening the lock cylinder. In the basic version, the cable is preferably designed such that it has a reserve region which can be used to extend the lock cylinder.

In accordance with one development of the invention, the two cylinder halves are connected detachably to one another by a connecting web. In order to extend the lock cylinder, the two cylinder halves can be separated from one another and reassembled once one or more extension pieces have been installed.

In accordance with one development of the invention, provision is made for it to be possible for the connecting web to be used for various cylinder lengths. For this purpose, the cylinder web has a surplus of holes, which are each used depending on the cylinder length.

In accordance with one development of the invention, the connecting web has a groove on its underside, the cable being laid in said groove. As a result, the cable can be integrated in the connecting web, which facilitates fitting and also any extension.

The invention also relates to a rotary knob for an electromechanical lock cylinder as claimed in claim 1. The rotary knob forms a unit, which can be fixed detachably to the extension of the rotary knob rotor.

In accordance with one development of the invention, the rotary knob has a pot-shaped handle part, into which, at the front, open end, a bearing disk is inserted which has an opening for passing through a cable and an opening for accommodating a connecting pin. By means of the connecting pin, the electronics of the rotary knob are coupled to the housing of the second cylinder half. The cable which connects the electronics to the actuator is drawn through the second opening.

In accordance with one development of the invention, the bearing disk is fixed to the pot-shaped handle part by a snap ring. It is therefore possible to replace the batteries accommodated in the rotary knob in a simple manner.

In accordance with one development of the invention, the rotary knob is fixed detachably to the rotary knob rotor by a snap ring.

In accordance with one development of the invention, the rotary knob has a slide sleeve in the pot-shaped handle part, in which slide sleeve a carrier for the electronics is mounted. At least one battery is preferably likewise accommodated in this carrier.

The invention also relates to a construction kit for producing an electromechanical lock cylinder as claimed in claim 1. This construction kit comprises at least one first cylinder half having tumblers and an actuator, which can be driven electronically and with which the rotor of the first cylinder half can be blocked, having a second cylinder half, which has an extended rotary knob rotor, on which a rotary knob is mounted, having intermediate pieces, with which the rotary knob rotor can be extended and having further intermediate pieces, with which the housings of the first and the second cylinder halves can be extended. With this construction kit it is possible for electromechanical cylinder locks of different lengths to be produced. A lock cylinder which has already been installed can also be extended or shortened at any time, if required.

BRIEF DESCRIPTION OF THE DRAWINGS

One exemplary embodiment of the invention will be explained in more detail below with reference to the drawing, in which.

DETAILED DESCRIPTION OF THE PREFERRED EMBODIMENT(S) OF THE INVENTION

Figure 1:
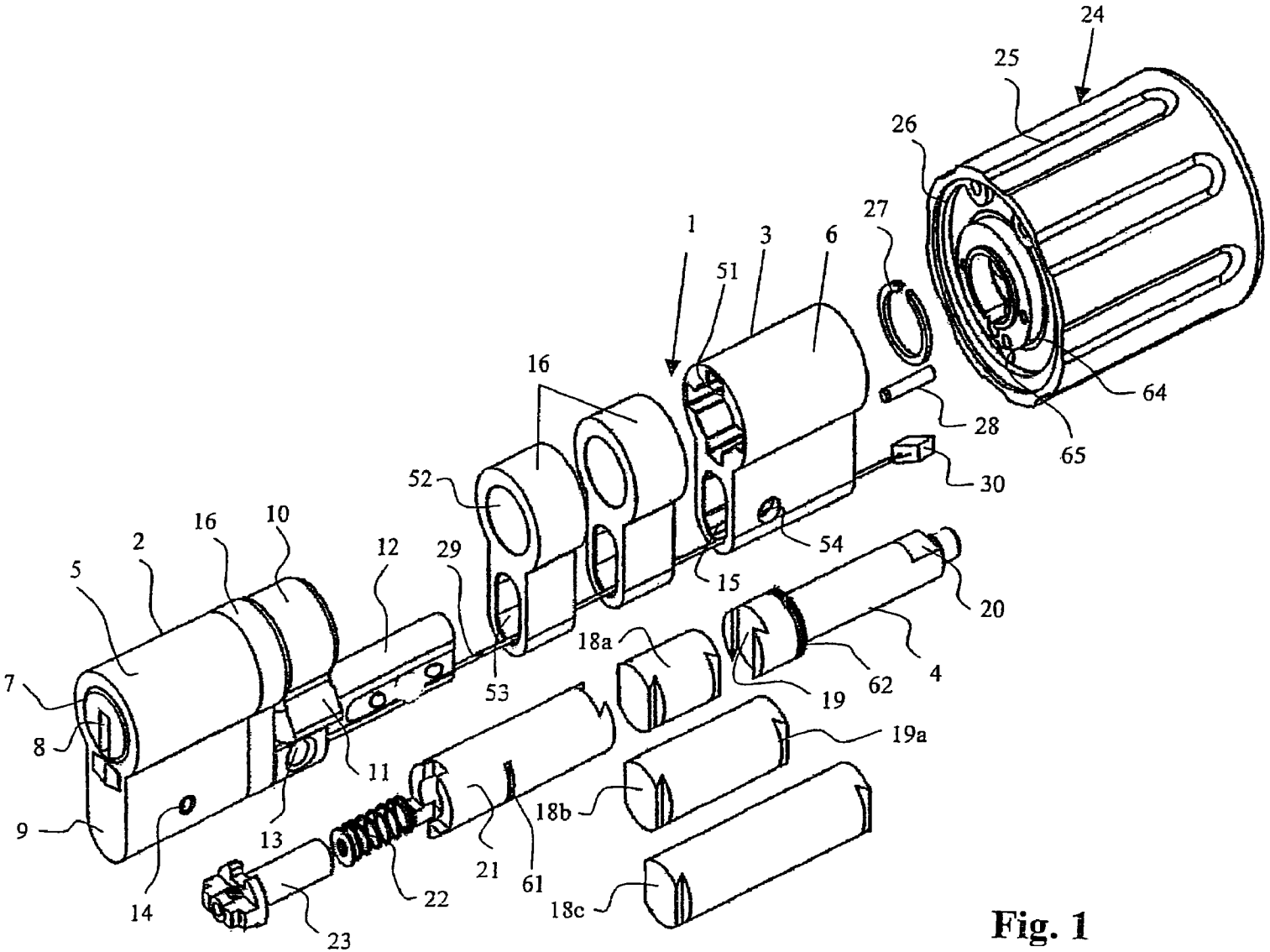
FIG. 1 shows a perspective view of a lock cylinder according to the invention, individual parts being withdrawn from one another.
Figure 4:
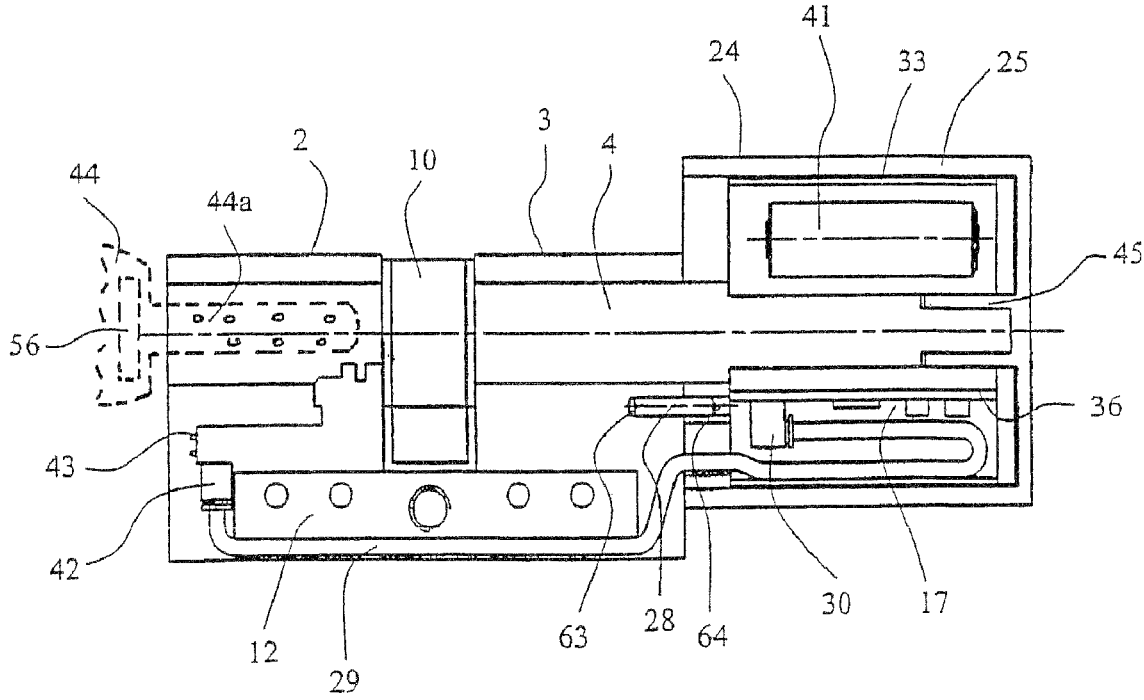
FIG. 4 shows a simplified sectional illustration of a cylinder lock according to the invention.
Figure 5:
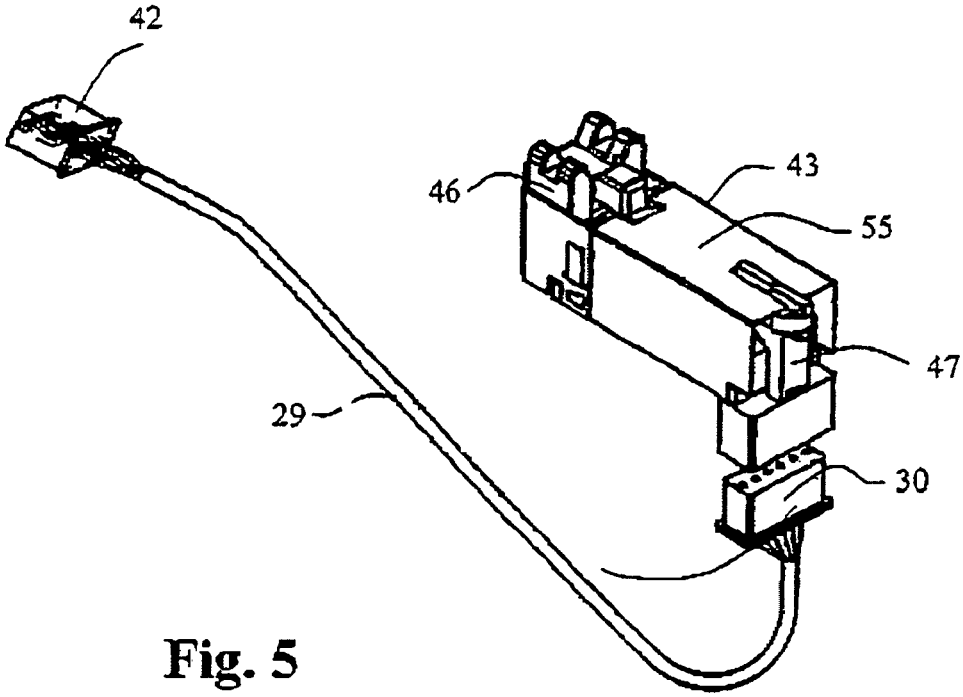
FIG. 5 shows a perspective view of an actuator and a connection cable.

The lock cylinder 1 shown in FIG. 1 has essentially a first cylinder half 2, a second cylinder half 3 and a rotary knob 24. The two cylinder halves 2 and 3 are connected detachably to one another by a connecting web 12. The first cylinder half 2 has a housing 5 and a rotor 7 and pin tumblers (not shown here) which can be positioned by a key 44 indicated in FIG. 4. For this purpose, the rotor 7 has a key channel 8. In addition, the further blocking apparatus, which is shown in FIG. 5 and can be driven by a signal from electronics 17 accommodated in the handle part 25, is arranged in the first cylinder half 2.

A driver 10 is arranged between the two cylinder halves 2 and 3 and has a beard 11, with which a bolt (not shown here) of a lock can be actuated. The driver 10 is connected, such that it is fixed against rotation, to a rotary knob rotor 4, which in turn is connected, such that it is fixed against rotation, to the rotary knob 24. By means of rotating the rotary knob, the driver 10 can be rotated and therefore the mentioned bolt displaced. A coupling member 23, which can be displaced axially counter to the reactive force of a spring 22, is connected to the driver 10 when the key 44 is inserted into the key channel 8 of the rotor 7. The driver 10 can therefore be rotated by means of an authorized key 44, and therefore the mentioned bolt can likewise be displaced.

The second cylinder half 3 has a housing 6 having a passage 51, in which the rotary knob rotor 4 is mounted. The housing 6 can be extended by extension pieces 16, which have the same profile as the housing 6 and which each likewise have a passage 52. The housing 5 of the first cylinder half 2 can also be extended by these extension pieces 16. If such extension pieces 16 are used, the rotary knob rotor 4 must be correspondingly extended. For this purpose, extension pieces 18*a*, 18*b* and 18*c* of different lengths are provided. In order to connect the extension pieces 18*a* to 18*c* to the rotary knob rotor 4, said rotary knob rotor 4 has a dovetailed groove 19, into which a corresponding slide part 19*a* of the intermediate piece 18*a*, 18*b* or 18*c* can be inserted. An identical connection is also provided with a coupling piece 21. The coupling piece 21 has a groove 61, into which a latching element (not shown here) is inserted with which the coupling piece is anchored on the cylinder.

The cylinder housing 6 also has a cutout 15 in a cylinder sack, which cutout 15 accommodates one half of the connecting web 12. In order to anchor the housing 6 on the connecting web 12, the housing 6 has a hole 54 for accommodating a pin 14. The extension pieces 16 likewise have corresponding cutouts 53. The connecting web 12 has, in the center, an enlarged section 49 (FIG. 6) with a fore-end screw hole 13.

Figure 2:
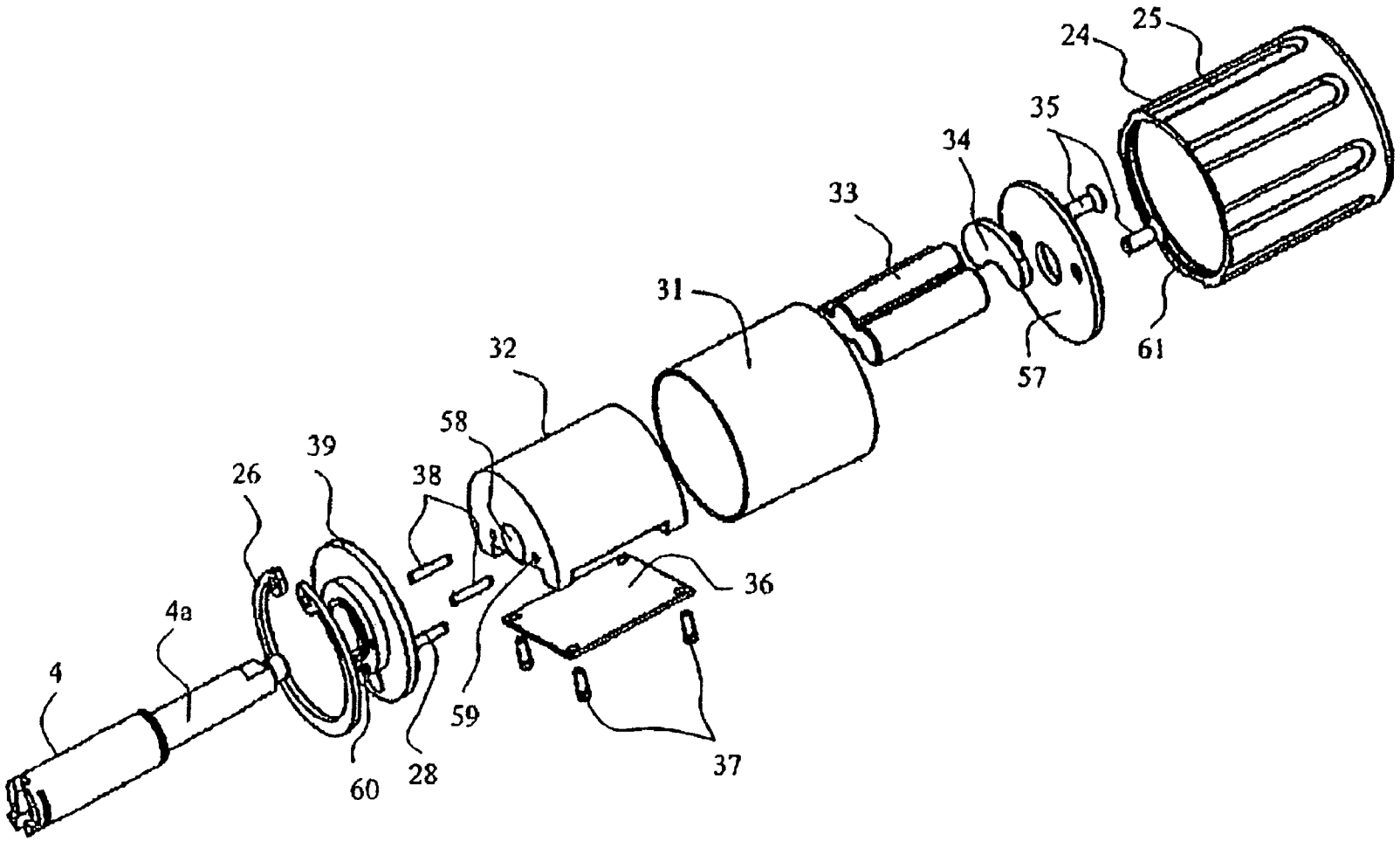
FIG. 2 shows a perspective view of the rotary knob and the rotary knob rotor, in this case individual parts also being withdrawn from one another.

As has already been mentioned above, the first cylinder half 2 has conventional pin tumblers, which are positioned by control faces (not shown here) of the key 44. These control faces are realized, for example, by holes in the shank 44*a* of the key 44. The key 44 is preferably a reversible key, but in principle it may also be in the form of a so-called serrated key or have another form. In order to electronically block the rotor 7 of the first cylinder half 2, the blocking apparatus 43 shown in more detail in FIG. 5 is provided. This blocking apparatus 43 is mounted in the lower part and therefore in the cylinder sack 9 of the housing 5, as shown in FIG. 1. The blocking apparatus 43 has a housing 55, on which a blocking part 46 is mounted, as shown in FIG. 5. This blocking part 46 can be moved between two positions by a motor (not illustrated here) which is accommodated in the housing 55. In one of the positions, the blocking part 46 engages in cutouts in the rotor 7 and blocks them with respect to the housing 55. In the other, withdrawn position, this engagement is cancelled. In addition, an antenna 47 is arranged on the housing 55 and receives signals from a transmitter 56 which is arranged in the key 44. The blocking part 46 and the antenna 47 form a unit, which does not impair the mechanical functioning of the pin tumblers. The blocking apparatus 43 is connected, via an electrical cable 29, to electronics 17, which are arranged in the rotary knob 24 and therefore on the inside of the door, as shown in FIG. 4. The blocking apparatus 43 is connected to a current source and in particular a battery 41 via the cable 29 for the purpose of actuating the motor, which battery is likewise arranged in the rotary knob 24, as shown in FIG. 4. The battery 41 and the electronics 17, which are arranged on a plate 36, are fixed to a carrier 32, which is shown in FIG. 2. A battery holder 33 is inserted in the carrier 32 and is fixed on a disk 57 by means of cellular rubber 34, which disk 57 is fixed to the carrier 32 by two fixing screws 35. The plate 36 with the electronics is fixed to the carrier 32 by four fixing screws 37. In order to accommodate an extension 4*a* of the rotary knob rotor 4, the carrier 32 has a passage 58. A bearing disk 39, which is connected such that it is fixed against rotation to two pins 38, is arranged on the carrier 32. In order to accommodate the two pins 38, the carrier 32 has two corresponding holes 59 on the front. The carrier 32 is arranged in a circular-cylindrical sleeve 31, which is produced from plastic and is used as the slide sleeve for the handle part 25.

In order to replace the battery 41, the lock cylinder needs to be disassembled in order that the snap ring 26 is accessible. It is therefore hardly possible to remove the battery 41 without this being noticed.

Figure 3:
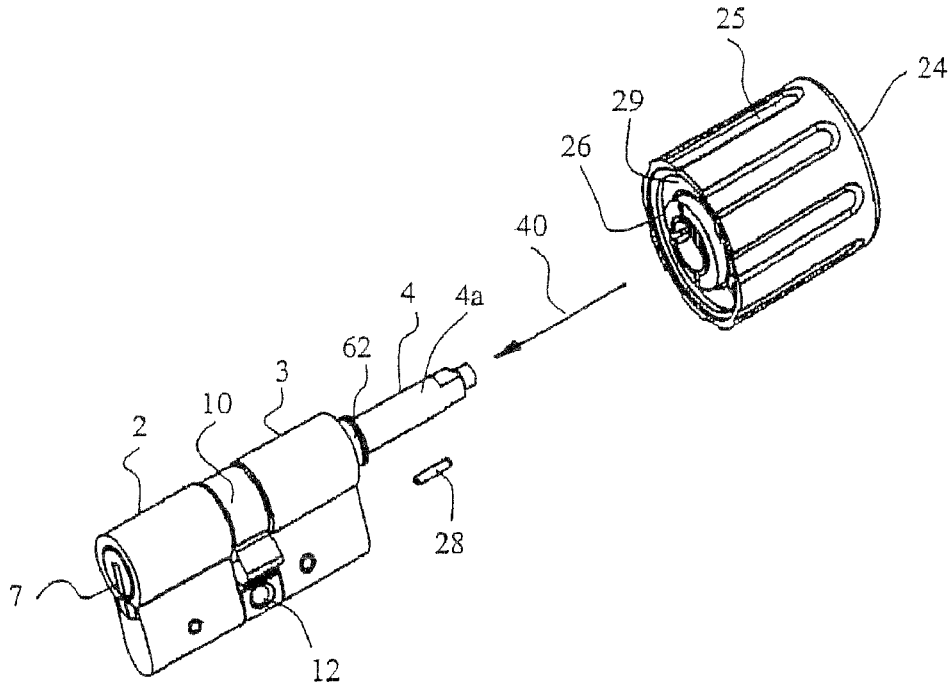
FIG. 3 shows a perspective view of each station of the floating mounting of the rotary knob on the lock cylinder.

FIG. 3 shows the position of the bearing disk 39, which, as mentioned, is connected such that it is fixed against rotation to the carrier 32 and therefore to the electronics 17. In order to accommodate the extension 4*a* of the rotary knob rotor 4, the bearing disk likewise has a central passage 60. In order to axially fix the bearing disk 39, a snap ring 26 is provided which is inserted into a groove 61 in the handle part 25, as shown in FIG. 3. The rotary knob 24 therefore forms a compact unit with the bearing disk 39, the electronics 17 and the batteries 41. FIG. 3 shows the manner in which the rotary knob 24 is pushed axially onto the rotary knob rotor 4 in the direction of the arrow 40.

In order to fix the rotary knob 24 on the rotary knob rotor 4 axially such that it can be detached, said rotary knob rotor 4 has a groove 62 on the outside for the purpose of accommodating a snap ring 27, which connects the rotary knob 24 to the rotary knob rotor 4 detachably. In order that the rotary knob rotor 4 rotates concomitantly with the handle part 25, the rotary knob rotor 4 has a surface 20 at the free end which forms a stop in a driver 45.

If the rotary knob 24 is fixed on the rotary knob rotor 4, the rotary knob rotor 4 and, with it, the driver 10 can be rotated. In this case, only the handle part 25 is preferably rotated with the rotary knob rotor 4. The electronics 17 and the batteries 41, on the other hand, are connected in a floating manner to the housing of the second cylinder half 3 by a pin 28, as shown in FIG. 4. As shown in FIG. 4, the pin 28 engages with one end in a cutout 63 in the housing 6 and with the other end in a cutout 64 in the bearing disk 39. The cutout 63 or the cutout 64 are designed such that the pin 28 is mounted in a floating manner with radial play in at least one of these two cutouts. This prevents impacts, which are caused for example by a door being slammed shut, from being transmitted to the electronics 17.

The bearing disk 39 has a further hole 65, through which the cable 29 is drawn, as shown in FIG. 4. The cutouts 64 and 65 can also be replaced by a common and correspondingly larger cutout (not shown here). The cable 29 and the pin 28 are then mounted in this cutout. The bearing disk 39 is therefore connected to the second cylinder half 3 in a floating manner by the pin 28. The connection is a plug-in connection, with the result that only one hole is required in the second cylinder half 3 for the purpose of accommodating the pin 28. Such a hole can be fitted in the case of each conventional cylinder profile and in particular in the case of the cylinder profiles shown in FIGS. 8*a* to 8*d*. In order to produce the electromechanical lock cylinder in accordance with the present invention, all conventional profiles can therefore be used, in which case there is comparatively little conversion work. The mechanically proven design of the rotary knob rotor with the rotary knob coupling or the coupling member 23 does not need to be substantially changed. In terms of lock technology, the first cylinder half 2 can be completely fitted with tumbler pins. The rotary knob rotor 4 is a universal carrier of rotary knobs 24 having different external shapes and profiles. A rotary knob 24 without any electronics can therefore also be used.

Figure 6:
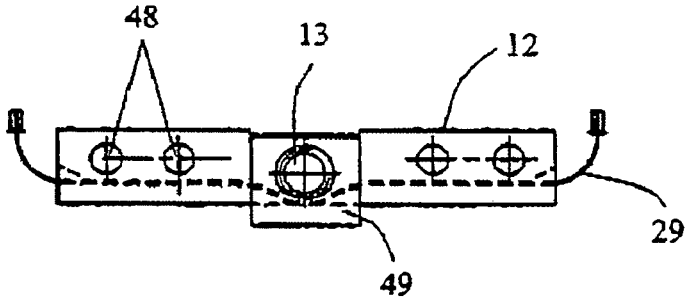
FIG. 6 shows a view of a connecting web with an inserted cable.
Figure 7:
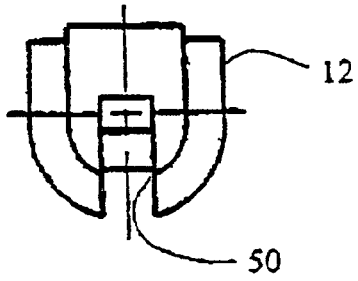
FIG. 7 shows a view of the connecting web, the cable being omitted.
Figure 8A:
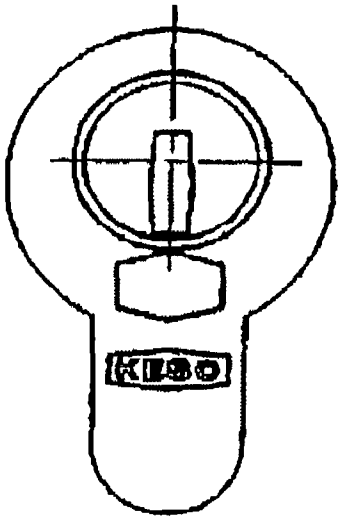
FIGS. 8*a*-8*d* show views of different profiles of the lock cylinder according to the invention.
Figure 8B:
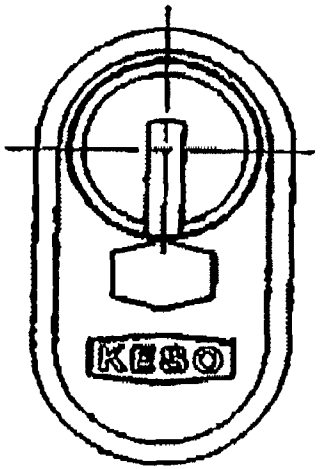
Figure 8C:
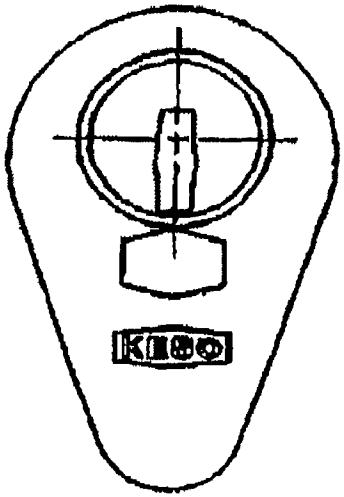
Figure 8D:
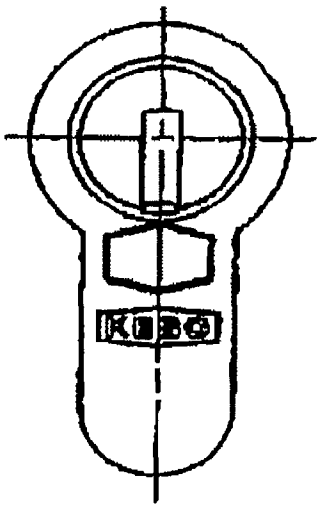

Owing to the simple design and the possibility of extending the two cylinder halves 2 and 3 and the rotary knob rotor 4, it is possible to extend or shorten the electronic lock cylinder according to the invention at the point of installation. The two plugs 30 and 42 make it possible to detach the cable 29 from the blocking apparatus 23 and the electronics 17. This can also be carried out by a non-professional. The connecting web 12 can be used universally for different cylinder lengths with the integrated cable 29. As is shown in FIGS. 6 and 7, the connecting web 12 has a groove 50 on its underside, into which groove the cable 29 is inserted. The cable 29 can only be seen from the outside from below in the region of the enlarged section 49. Of the four passages 48, in each case only two are used, with the result that in total four different lengths can be fitted with the connecting web 12. As has been mentioned, it is thus possible for there to be considerable reductions in terms of storage and costs.

LIST OF REFERENCE SYMBOLS

1 Lock cylinder
2 First cylinder half
3 Second cylinder half
4 Rotary knob rotor
4*a* Extension
5 Housing
6 Housing
7 Rotor
8 Key channel
9 Cylinder sack
10 Driver
11 Beard
12 Connecting web
13 Fore-end screw hole
14 Pin
15 Cutout
16 Extension pieces
17 Electronics
18*a* Intermediate piece
18*b* Intermediate piece
18*c* Intermediate piece
19 Dovetailed groove

19*a* Slide part
20 Surface
21 Coupling piece
22 Spring
23 Coupling member
24 Rotary knob
25 Handle part
26 Large snap ring
27 Small snap ring
28 Pin
29 Cable
30 Plug
31 Sleeve
32 Carrier
33 Battery holder
34 Cellular rubber
35 Connection screw
36 Plate
37 Connection screw
38 Pins
39 Bearing disk
40 Arrow
41 Battery
42 Plug
43 Blocking apparatus
44 Key
44*a* Shank
45 Driver
46 Blocking part
47 Antenna
48 Holes
49 Enlarged section
50 Groove
51 Passage
52 Passage
53 Cutouts
54 Hole
55 Housing
56 Transmitter
57 Disk
58 Passage
59 Holes
60 Passage
61 Groove
62 Groove
63 Cutout
64 Cutout
65 Cutout

The invention claimed is:

1. An electromechanical lock cylinder, having a first cylinder half adapted to be arranged on the outside of a door, having a key channel for a safety key and a second cylinder half to be arranged on the inside of the door, having a rotary knob rotor, which is connected to a rotary knob, having tumblers, which are arranged in the first cylinder half and which are to be positioned by the safety key in order to enable rotation, having electronics arranged in the rotary knob for the purpose of driving a blocking apparatus, which can block the rotation, wherein the rotary knob with the electronics arranged therein forms a unit which is mounted detachably so that it can be plugged on an extension, which protrudes on a housing, of the rotary knob rotor, wherein the electronics are connected to the housing of the second cylinder half by means of a plug-in connection.

2. The lock cylinder as claimed in claim 1, wherein the plug-in connection has a pin (28), which is inserted into a cutout (63) in the housing (6) of the second cylinder half (3).

3. The lock cylinder as claimed in claim 2, wherein the pin (28) is mounted, in a floating manner, in the cutout (63).

4. The lock cylinder as claimed in claim 1, wherein a cable (29) is connected detachably to the blocking apparatus (43) and the electronics (17).

5. The lock cylinder as claimed in claim 4, wherein the cable (29) has a plug (30, 42) at each of its ends.

6. The lock cylinder as claimed in claim 4, wherein the cable (29) is introduced through a groove (50) of a connecting web (12).

7. The lock cylinder as claimed in claim 6, wherein the connecting web (12) has a surplus of holes (48) for accommodating a connecting pin (14).

8. The lock cylinder as claimed in claim 1, wherein the rotary knob (24) has a bearing disk (39), which covers the electronics (17) and is connected detachably to a pot-shaped handle part (25).

9. The lock cylinder as claimed in claim 8, characterized in that the bearing disk (39) has an opening for a connecting pin (28) and an opening through which a cable (29) is passing.

10. The lock cylinder as claimed in claim 8, wherein the bearing disk (39) is fixed detachably to the handle part (25) by a snap ring (26).

11. The lock cylinder as claimed in claim 1, wherein the rotary knob (24) is fixed detachably to the rotary knob rotor (4) by a snap ring (27).

12. The lock cylinder as claimed in claim 1, wherein a slide sleeve (31) is arranged in the rotary knob (24), a carrier (32) for the electronics (17) being mounted in said slide sleeve (31).

13. A construction kit for producing an electromechanical lock cylinder, wherein a first cylinder half (2) having tumblers and an actuator (43) arranged in the first cylinder half, which can be driven electronically and with which a rotor of the first cylinder half (2) can be blocked, having a second cylinder half (3), which has an extendible rotary knob rotor (4), on which a rotary knob (24) is mounted, having intermediate pieces (18*a* to 18*c*), with which the rotary knob rotor (4) can be extended and having further intermediate pieces (16), with which a housing (5, 6) of the first and a housing of the second cylinder half (2, 3) can be extended, and wherein a connecting member (28), is provided with which electronics (17) arranged in the rotary knob (24) can be connected in a pluggable and floating manner to the housing (6) of the second cylinder half (3).

14. The construction kit as claimed in claim 13, wherein the two cylinder halves (2, 3) are guided by a connecting web (12), a cable (29) being laid in the connecting web (12).

* * * * *